US005740127A

United States Patent [19]

Van Steenwyk et al.

[11] Patent Number: 5,740,127

[45] Date of Patent: Apr. 14, 1998

[54] PULSE PRODUCTION AND CONTROL IN DRILL STRINGS

[75] Inventors: Donald H. Van Steenwyk, San Marino; Roy W. Case, Atascadero, both of Calif.

[73] Assignee: Scientific Drilling International, Houston, Tex.

[21] Appl. No.: 700,884

[22] Filed: Aug. 21, 1996

[51] Int. Cl.[6] ..... F16K 31/04; E21B 47/022; G01V 1/40

[52] U.S. Cl. ..... 367/85; 175/40; 33/307

[58] Field of Search ..... 367/85; 175/40, 175/50; 166/250; 33/307

[56] References Cited

U.S. PATENT DOCUMENTS 4,771,408 9/1988 Rodlyar ..... 367/83

5,272,680 12/1993 Stane et al. ..... 367/85

*Primary Examiner*—Nelson Moskowitz

*Attorney, Agent, or Firm*—William W. Haefliger

[57] ABSTRACT

In fluid pulsing apparatus operable in a drill pipe in a well in which well drilling fluid flows, wherein pressure pulses are created by restricting one or more of several hydraulically parallel paths, constant working pressure regulating valves with a long time constant relative to the transient pulses are constructed in the hydraulically parallel paths. The valves operate to produce a more consistent pulse character allowing production of pulses at low flow rates of drilling fluid that are of sufficient amplitude to be more easily detected on the Earth's surface and restriction of amplitude of pressure pulses at high flow rates of drilling fluid to limit equipment damage and loss of hydraulic energy. The valves function by varying the flowing cross sectional area of the hydraulically parallel paths.

31 Claims, 6 Drawing Sheets

PULSE PRODUCTION AND CONTROL IN DRILL STRINGS

BACKGROUND OF THE INVENTION

This invention relates generally to the transmission of information from near the bottom of a wellbore to the surface of the earth via production of positive and negative pressure pulses in drilling fluid being circulated downwardly in a drill pipe string. More particularly, it concerns improvements in apparatus and methods associated with production of such pulses.

In U.S. Pat. No. 4,550,392 to Mumby, incorporated herein by reference, positive pulses are produced, while well fluid flows downwardly through an annular space, the effective cross sectional area of which remains unchanged, i.e., is fixed, that space surrounding a valving apparatus in another flow path. The valving apparatus can close off the one flow path forcing all flow to circulate through the other, unchanging, cross sectional area. The increased volume through the constant, unchanging area flow path results in increased pressure drop across the apparatus. By closing, then opening, the valving apparatus, a pulse is created.

As a result of this unchanging flow cross sectional area, there are disadvantages that limit the ability to control the characteristics of the resultant pulse. One prominent disadvantage is inability to control physical characteristics of the resultant pressure pulse. For example changes in the flow rate or physical properties of the fluid change the working pressure across the valving mechanism and change the pulse amplitude.

There is need to control these physical characteristics because it is found that pulse amplitudes can become too small, for detection of the pulse at the surface. Conversely, the pulse can become too large causing equipment damage and unnecessary erosion and energy drain. Variations in generated pulse amplitude can override otherwise predictable attenuation of pulse pressure amplitude with path length, drill fluid density, drill fluid viscosity, and drill fluid shear strength.

SUMMARY OF THE INVENTION

It is a major object of the invention to provide a solution to the above-mentioned problem.

Basically, the method of the invention includes the steps:

a) producing the positive pressure pulses in a downwardly flowing drilling fluid stream at a sub-surface location in the string, by restricting one or more flow paths, so these pressure pulses are transmitted upwardly in the fluid, b) varying the flow area of the alternative, parallel flow path, thereby introducing or removing a restriction, thus controlling the amplitude of the pulses.

As described below, a separate valve means is typically provided in a parallel flow path, which may be annular or collinear, to the interruptible path. The described valve means controllably alters the cross sectional flow area of this parallel flow path. The valve means may be yieldable, as via spring means, to increasingly pass the downwardly flowing well fluid in response to increasing downward pressure exerted by the flowing drilling fluid.

Also, a plurality of valves may be provided with either the same or differing pass characteristics as the downward pressure exerted by the flowing drilling fluid varies. Also, a combination of valves and flow ports may be provided.

Another object is to provide a means in the form of multiple valves that are spring urged to yieldably open, increasing, in response to increased pressure of the flow, thereby to vary the flow area to achieve the desired benefits, as described.

Another object of this invention comprises providing an apparatus that includes:

a) structure including multiple hydraulically parallel flow channels, one of which includes valving means which when closed, increases pressure drop across the alternate flow channels, the increase which is removed when this valving means is opened, resulting in an ability to create a pressure pulse within the fluid stream flowing downwardly through the drill pipe, the pressure pulse then propagating upwardly to a point within the drill string hydraulically upstream of the pulse-generating apparatus, b) and other means for varying the cross sectional area of the hydraulically parallel flow channels through which the fluid flows downwardly through an increase pressure drop, when the valving means is closed, for controlling the amplitude of the upwardly transmitted pulses.

A wireline may be attached to the structure, for displacing it lengthwise in the string relative to the other means referred to. That other means may include a body means having a shoulder, commonly known in the industry as landing ring or muleshoe landing, to engage the structure for positioning in the string. That means, known as a landing ring or muleshoe landing, may include the other means, for varying the cross section area of the flow channel.

Another object includes provision of said structure to comprise:

i) a tubular body defining a passage to pass well fluid downwardly past the zone, ii) and valving for controllably interrupting the passing of well fluid downwardly past the zone.

As will be seen, such valving typically includes a valve seat, a valve member movable toward and away from the seat, and a piston movable in a bore in the body, and in response to controllable application of well fluid pressure to the piston to control reciprocation of the member in the bore.

A further object includes provision of a tube extending endwise in the body and having well fluid inlet porting above the seat and well fluid exit porting below the seat to alternatively pass well fluid pressure to the piston, and to the exterior of the body. A first annular seal typically seals off between the piston and bore, and a second annular seal seals off between the piston and the tube, the tube extending downwardly within the piston. This structure provides for simplicity of interfitting of parts and guidance of piston reciprocation.

Additional objects include provision of a flow diverter carried by the body at a location above the upper end of the tube to divert well fluid to flow toward the zone, and also toward the passage; and provision of a filter carried by the body to filter fluid flowing toward the passage.

These and other objects and advantages of the invention, as well as the details of an illustrative embodiment, will be more fully understood from the following specification and drawings, in which:

DRAWING DESCRIPTION

DETAILED DESCRIPTION

Figure 1:
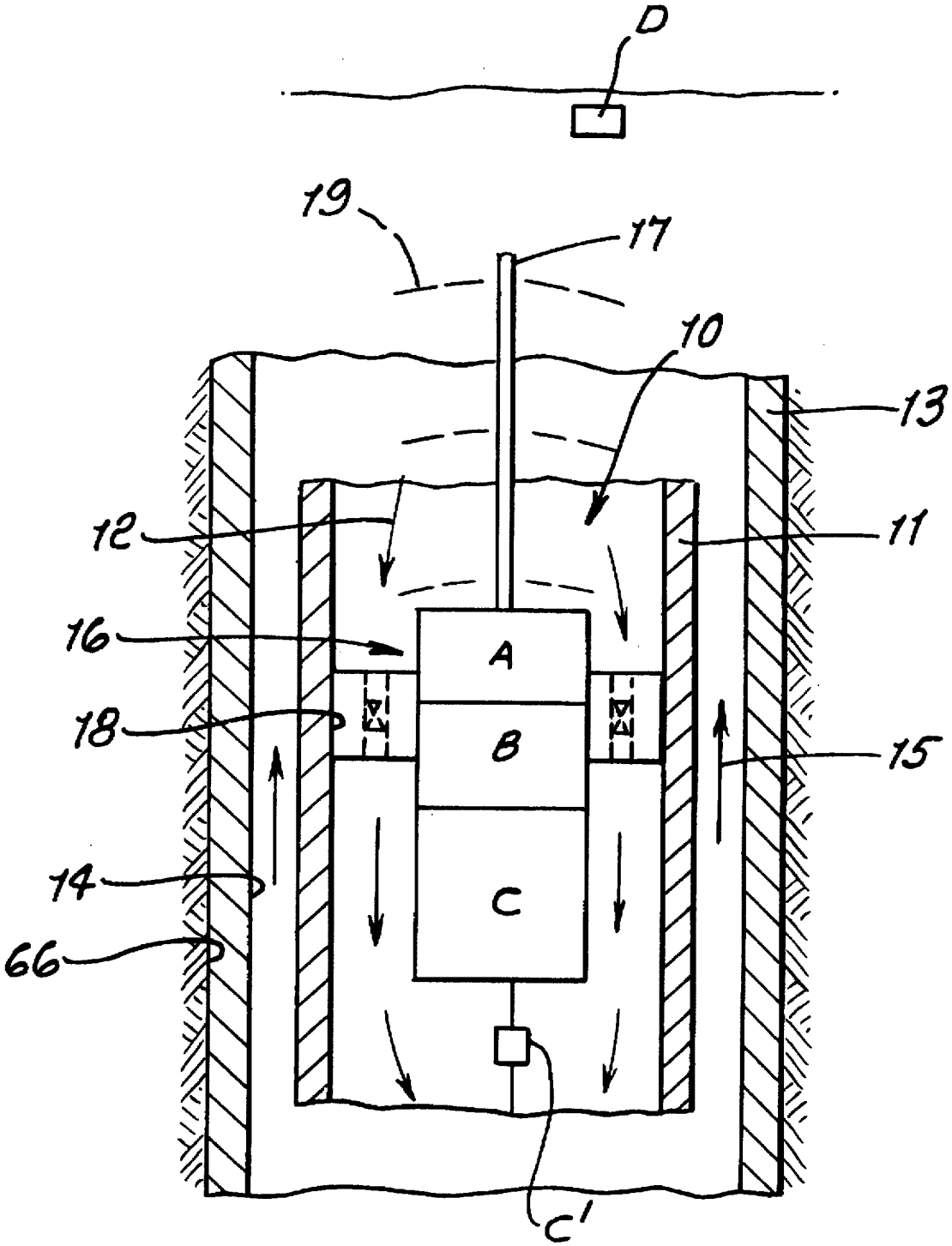
FIG. 1 is a schematic view showing one form of the invention.

In FIG. 1, apparatus 10 includes a structure, generally indicated at 16 that contains valving apparatus, i.e., the first means to produce pulses, indicated by dashed lines 19 in the well fluid, such pulses translated along a drill pipe or drill collar string 11. Well drilling fluid, or drilling mud, flows downwardly in the string, as indicated by arrows 12. In this path, it is constrained by the internal diameter of the string bore 18. Although well casing is indicated at 13, annulus indicated at 14 may be located between the drill string 11 and an earth borehole 66 inside the diameter. The return fluid contains cuttings created by the drill bit (not shown) and travels up this annulus 14, as indicated by arrows 15.

Within the structure 16, three means are indicated. The first means is indicated at A and is the means to produce pulses and may include valving elements, as disclosed in U.S. Pat. No. 4,550,392 to Mumby, or in U.S. Pat. No. 4,120,097 to Jeter, both patents incorporated herein by reference. Other types of pulse-producing devices are usable.

An actuator means is substantially shown at B for translating electrical energy from a source (not shown) to drive the pulse-creating means A; and circuitry at C is responsive to sensors shown at C', so as to modulate production of pulses in accordance with information or data transmitted upwardly to a surface detector, indicated schematically at D. The structure 16, which may be tubular, is capable of being run in the string 11 on a wireline 17, while fluid flows in the string.

Figure 2:
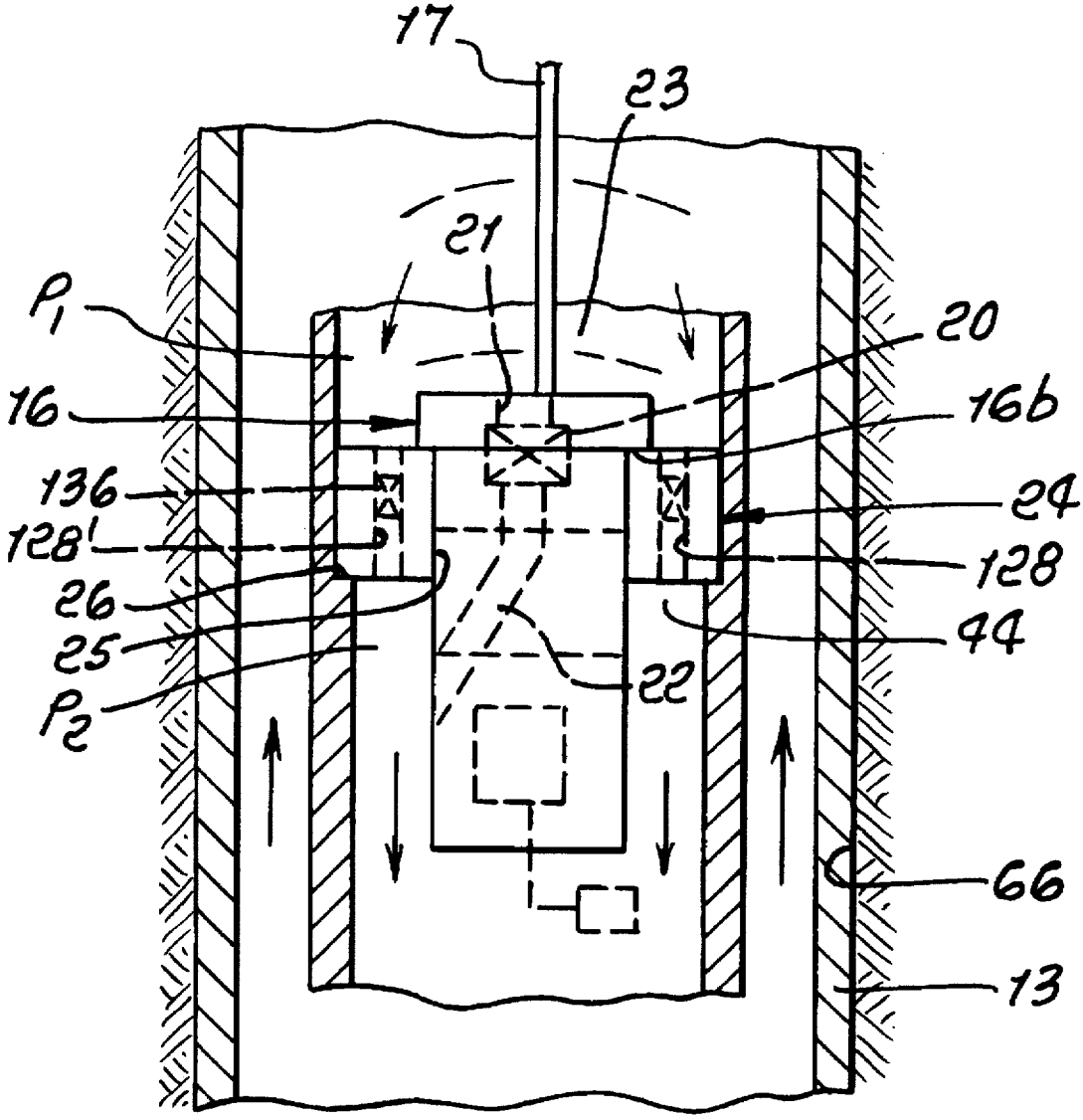
FIG. 2 is a view like FIG. 1 but showing more detail.

Referring to FIG. 2, the structure 16 is shown translated in the string into an annular body 24, which contains flow passages 128 and 128'. Body 24 also defines a receiving passage 25, or bore, which is constructed for receipt of 16. The receiving passage 25 and flow passages 128 and 128' may be located within a landing ring or muleshoe. When the structure 16 comes to rest, it is in a preferred orientation and position by virtue of a correctly located and constructed upset on the outer diameter of the structure 16 as at **16*b*, FIG. 2, and rests or seats on the upper face of the annular body 24. The annular body 24 is itself suitably suspended, as indicated by a shoulder 26**, or other acceptable means within the string bore.

In FIGS. 1 and 2, the presence of the annular body 24 is seen to divide the passage within the drill string into two regions 23 and 44 relative to flow. The regions are connected by a passage 22 through the structure 16. These regions are also connected via flow passages 128 and 128' in 24. By virtue of the restriction to flow offered by the passages 128 and 128' in body 24, the upstream region 23 and downstream region 44 will possess different pressures $P_1$ and $P_2$, respectively.

The passage through the structure 16 enters an inlet duct 21 from the upstream region 23, and passes through a valving means 20, and exits through a passage 22 into the downstream region 44.

Figure 3:
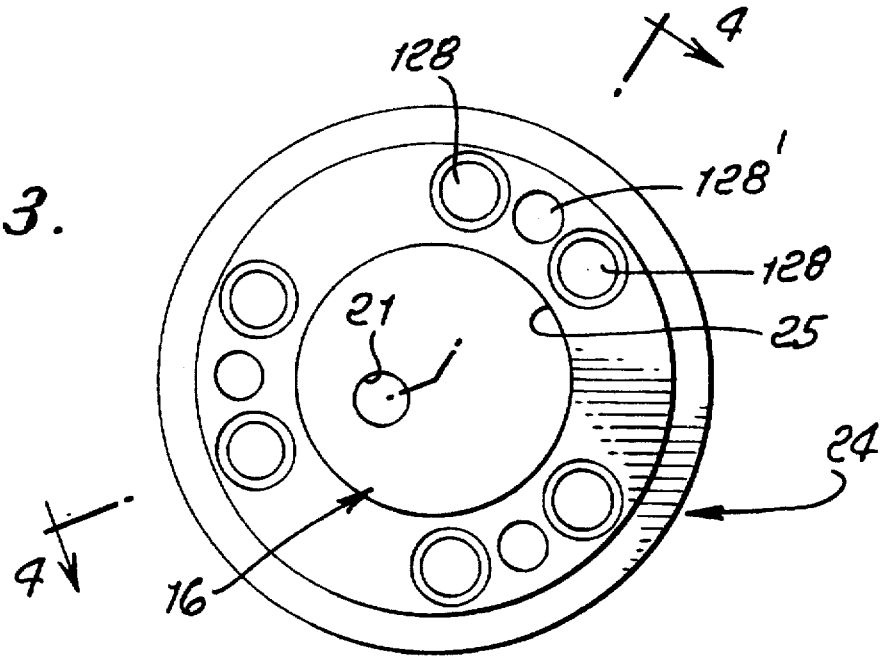
FIG. 3 is an enlarged top plan view schematic showing a proposed form of the means to vary the flow cross sectional area, sidewardly of flow channel containing the valving means.
Figure 4:
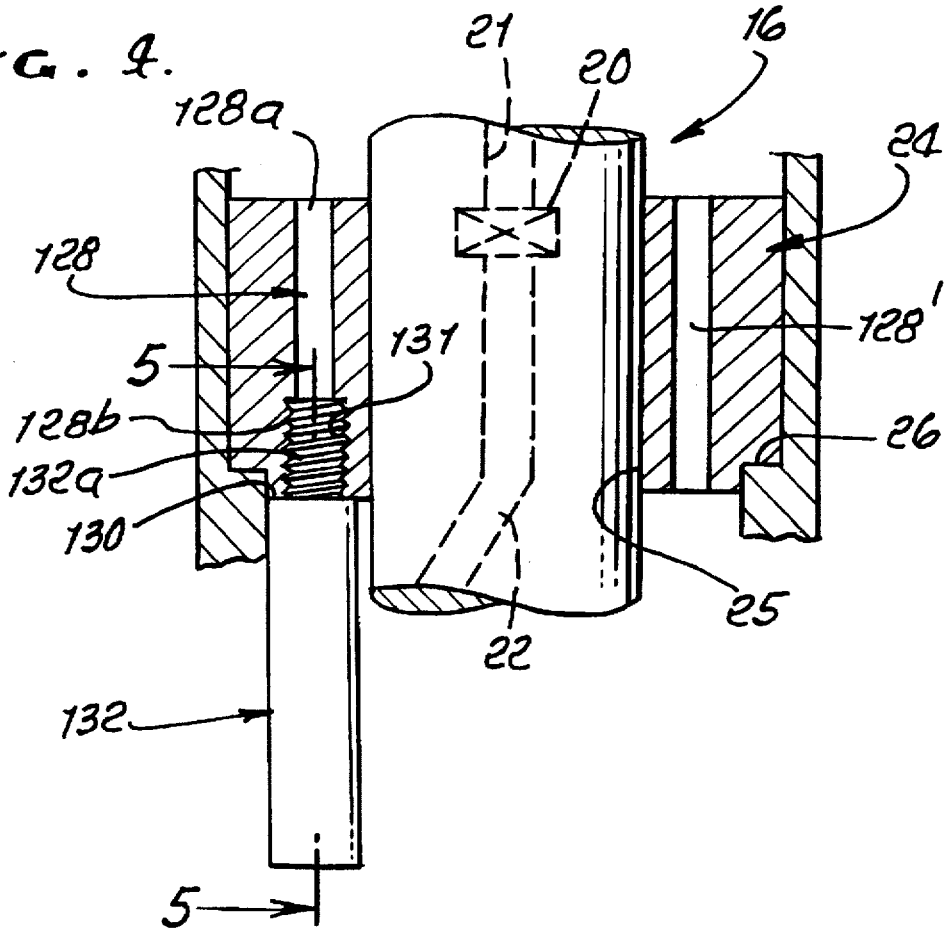
FIG. 4 is a sectional schematic taken on lines 4—4 of FIG. 3.

Referring to FIG. 4, the flow passage 128 may contain a short receiving port **128*a* communicating with a threaded port 128*b*. FIGS. 3 and 4 show ports 128 spaced about bore 25, and with through ports 128' of fixed area located between pairs of ports 128**.

The threaded port **128*b* is adapted to support the variable area means, here shown as including sleeve 132. A threaded upper coupling extent 132*a* of 132 is received in threaded bore 131. This variable area flow means, which may include valve means 136, responds to changes in fluid pressure above and below 24, and/or changes in drilling fluid flow rates, or viscosity, or composition, to vary the flow area between the upstream region 23 and the downstream region 44, to produce the desired benefits. The valving means 136**, as for example a spring-urged valve employing a dashpot, variably controls the flow area, as will be explained below.

Referring now to FIG. 3, it shows the top of the annular body 24 suspended in the drill string with the outer surface of the structure 16 received in the receiving passage or bore 25. The two distinct types of flow passages 128 and 128' are illustrated. As referred to, passages 128 are threaded to support the variable area means, including sleeves 132 and valving means 136. Passages 128' are shown as constant area passages. FIG. 4 further illustrates the differences in these two types of flow passages, and shows hanging support the body 24 at string shoulder 26, so that the bore 25 of the annular body 24 passes structure 16.

Figure 5:
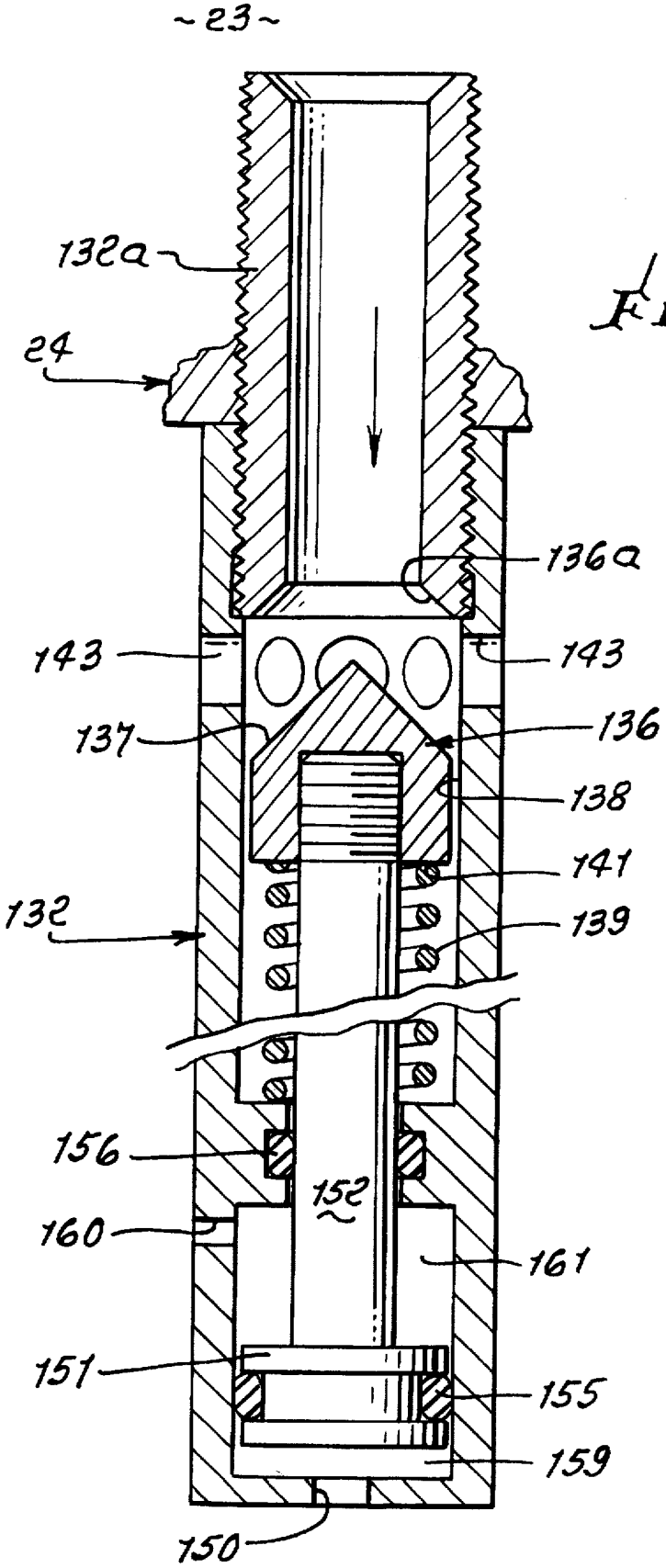
FIG. 5 is a further enlarged schematic view taken on lines 5—5 of FIG. 4.

As illustrated in FIG. 5, lower end of threaded coupling **132*a* is inserted in upper extent of sleeve 132. Upper end of coupling 132*a* is received in the matching internal thread 131 in the annular body 24 in lower end extent of passage 128, until the shoulder 130 on 132 engages the lower surface of the annular body 24**.

FIG. 5 shows details of the variable area valving means 136. Pressure $P_1$ of liquid at upper zone 23 is applied to the upper tapered surface 137 of 136 when surface 137 is seated on the tapered seat **136*a*. When the valve element is seated, the downstream pressure $P_2$ at zone 44 is applied through side ports 143 is applied to other surfaces of the valve means 136, and along the non-sealing bore wall 138 of the sleeve or housing 132**.

As flow variation at zones 23 and 44 causes the pressure $P_1$ to increase relative to $P_2$, there is a net opening force exerted downwardly on the valve element. That opening force is yieldably resisted by the spring force of spring 139 applied upwardly on the opposing face 141 of the valve element. The rate of alteration of the flow area of the valve with changes in the difference between $P_1$ and $P_2$ is restricted by reaction forces transmitted along shaft 152 of a dashpot formed in liquid-containing cavity 161 in the housing 132. Shaft 152 is connected at its lower end to the dashpot piston 151, and at its upper end to the valve element 136. Response to the dashpot is controlled by sealing the shaft 152 with seal 156, and the piston 151 with seal 155, leaving only controlled leaks at ports 160 and 150. Port 150 communicates pressure $P_2$ to the cavity antechamber 159. Pressure offset is accomplished by adjusting the spring preload and spring rate on spring 139. Time response, which allows the valve to yieldably respond only to pressure differences expressed over time long with respect to local transient, is accomplished by adjusting the controlled leaks at 160 and 150.

Orifices 150 and 160 restrict outflow of fluid from chambers 161 and 159 as the piston moves up and down, creating a dashpot effect, in conjunction with spring 139.

A selected number of such valves 136 is installed in body 24, to achieve desired modulation of the signaling pulses created by opening and closing of the valve means 16.

As an alterative, a dual acting, non cavitating apparatus may be formed by modifying the shaft 152 and adding a seal. For example, by extending shaft 152, after attachment to piston 151, through a seal (not shown) in position 150 and moving the lower controlled leak adjacent to piston 151. This results in two sealed chambers 161 and 159 connected via a controlled leak.

Figure 6:
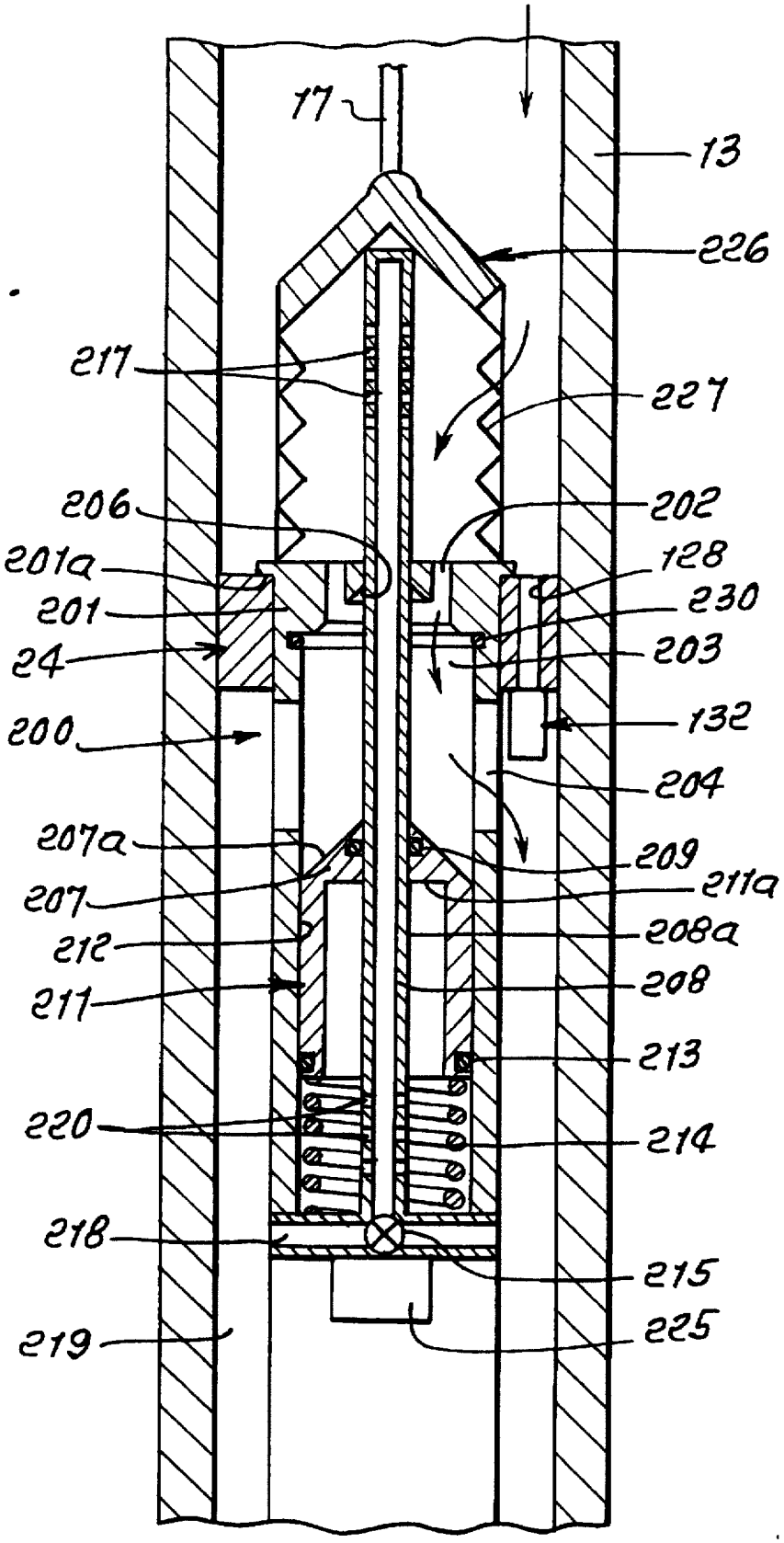
FIG. 6 is an elevation taken in section showing a pulse-producing means, in open position.
Figure 7:
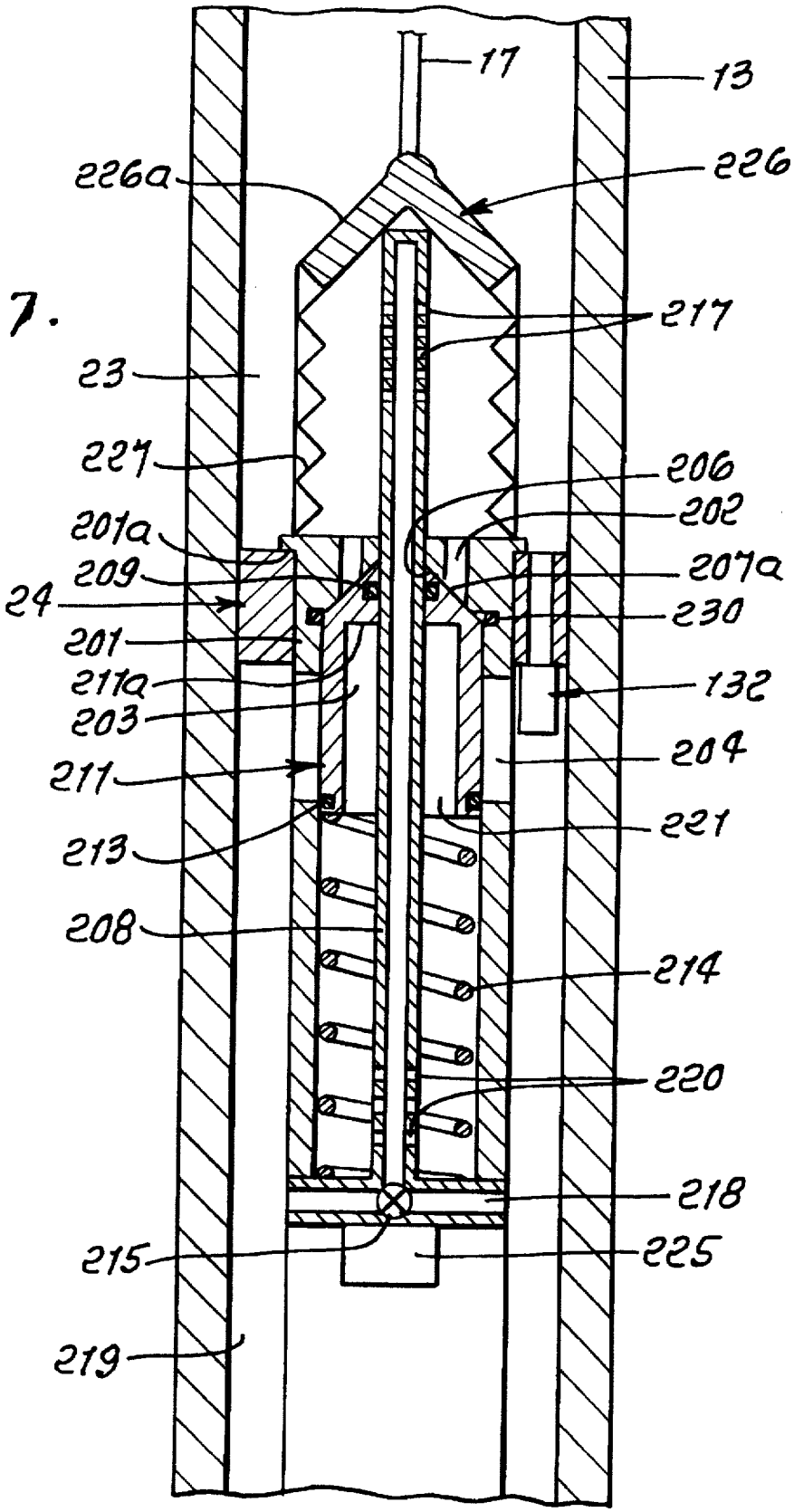
FIG. 7 is a view like FIG. 6 showing the pulse-producing means in closed position.

Reference is now made to FIGS. 6 and 7 showing a representative pulse-producing means indicated generally at 200, lowered in the drill string 13, and carried by body 24, as discussed above.

As shown, a tubular valving body 201 is vertically elongated and has a shoulder 201*a* seated on the body 24. Valving body 201 defines a passage to pass well fluid or liquid downwardly, as via passage sections 202, 203, and 204, as indicated by flow path arrows in FIG. 6. Under such condition, the valving passage is open to downward flow of well (hydraulic) liquid.

The valving is operable to controllably interrupt such downward passage of well fluid through passages 202, 203, and 204, and past body 24 discussed above. Body 24 varies the flow through its passage 128 and the flow controller 132 of variable cross section opening.

The valving means includes a valve seat 206, which is upwardly tapered, and a valve member 207 movable toward and away from the seat. When closed, as in FIG. 7, the tapered surface 207*a* of member 207 closes against seat 206, blocking downward flow, and a pulse is produced in the well fluid above the body 24, i.e., in region 23. That pulse travels upwardly in the string, and serves as a signaling pulse, as referred to above. Valve member 207 is annular, and its up and down movement is guided by a tubular stem 208. An annular seal 209 seals off between the bore of member 207 and the outer surface 208*a* of the stem. An annular seal 230 carried just below the seat 206 sealingly engages the tapered surface 207*a* in valve closed condition.

A piston 211, connected to valve member 207, is movable in body bore 212, in response to controllable application of well fluid pressure to the piston surface 211*a*, to control reciprocation of the valve member in the bore. Note that only one O-ring 213 seals off between the body bore 212 and the piston skirt, for simplicity. Also, this allows concentricity of sliding and alignment of the valve 207 on the stem, to prevent binding. Compression spring 214 exerts upward force on the piston, to assist in closing of the valve.

A pilot control valve 215 is located at the lower end of the stem 208 to control piston reciprocation when the pilot valve is open, as in FIG. 6, pressurized well fluid flows downwardly into the stem via ports 217, and exhausts via the lower end of the tubular stem and via side passages 218 into the string at 219. When the pilot valve is closed, the well fluid pressure in the stem flows via exit side (lower) ports 220, into the chamber 221, to exert upward pressure on the piston, to close valve member 207 against the seat 206, as seen in FIG. 7. A driver to open and close the pilot valve is shown at 225.

A flow diverter is shown at 226 at the upper end of the stem 208, to divert well fluid flow toward region 23 above body 24. Diverter 226 is upwardly tapered at 226*a*. Well fluid flow also passes through an annular filter 227 between the diverter and the top of the valving body 201, to block travel and access of said other particle to the valve elements 206 and 207.

We claim:

1. In fluid pulsing apparatus operable in a well drilling pipe string in which drilling fluid flows, the combination comprising:

a) a structure including first means to produce pulses in the well fluid and defining a first hydraulic path, and while said fluid is flowing in said string through a second hydraulic path located in parallel to the first hydraulic path, said pulses being transmitted upward in the string, b) and other means for varying the cross sectional flow area of the second hydraulic path, for controlling the amplitude and other characteristics of said upwardly transmitted pulses, c) and including a wireline connected to said structure for displacing said structure upwardly in the string.

2. In fluid pulsing apparatus operable in a well drilling pipe string in which drilling fluid flows, the combination comprising:

a) a structure including first means to produce pulses in the well fluid and defining a first hydraulic path, and while said fluid is flowing in said string through a second hydraulic path located in parallel to the first hydraulic path, said pulses being transmitted upward in the string, b) and other means for varying the cross sectional flow area of the second hydraulic path, for controlling the amplitude and other characteristics of said upwardly transmitted pulses, c) said other means including valving means for varying said area, d) and wherein said valving means comprises valve means oriented to increasingly open in response to increasing fluid pressure exerted by flowing fluid, or to increasingly close in response to decreasing fluid pressure exerted by flowing fluid.

3. The combination of claim 1 wherein said other means includes valving means for varying said area.

4. The combination of claim 3 wherein said other means includes multiple valves.

5. The combination of claim 4 wherein said valves extend in generally parallel relation to the direction of fluid flow.

6. The combination of claim 2 including a wireline connected to said structure for displacing said structure upwardly in the string.

7. In fluid pulsing apparatus operable in a well drilling pipe string in which drilling fluid flows, the combination comprising:

a) a structure including first means to produce pulses in the well fluid and defining a first hydraulic path, and while said fluid is flowing in said string through a second hydraulic path located in parallel to the first hydraulic path, said pulses being transmitted upward in the string, b) and other means for varying the cross sectional flow area of the second hydraulic path, for controlling the amplitude and other characteristics of said upwardly transmitted pulses, c) and wherein said other means includes body means having a shoulder to engage the string for positioning said structure in the string, sidewardly of the body means, said structure movable lengthwise of the string relative to said other means.

8. The combination of claim 7 wherein said other means includes valving means for varying said area, said valving means carried by said body means.

9. The combination of claim 8 wherein said valving means includes multiple valves.

10. The combination of claim 9 wherein said valves extend in generally parallel relation to the direction of fluid flow.

11. The combination of claim 8 wherein said valving means include spring-urged valve means oriented to increasingly vary in response to change in fluid pressure exerted by drilling fluid flow.

12. The combination of claim 10 wherein said body means is annular to define a central passage to slidably pass said structure, said valves spaced about said central passage.

13. The combination of claim 12 wherein said body means defines a plurality of through ports, there being a plurality of sleeves carrying said valves, said sleeves connected to said body means, in series communication with said through ports.

14. The combination of claim 13 including passages in said sleeves to pass well fluid, said valves movable to control said passages.

15. The combination of claim 1 wherein said first means includes a pulser valve to controllably pass a stream of said well fluid, and movable to produce said pulses.

16. The combination of claim 15 including an actuator to move said pulser valve, and circuitry including a sensor to control said actuator.

17. The combination of claim 1 including said drill string containing said first means and other means.

18. In the method of producing pulses in a well fluid in a well pipe string, the steps that include a) producing said pulses at a sub-surface location in the string, for pulse transmission upwardly in the fluid, while flowing drilling fluid downstream in the string past said location, through a zone located sidewardly of said location, b) and varying the flow cross sectional area of said sideward zone for controlling the amplitudes of said pulses, c) providing a pulse-producing structure at said location, and providing a wireline connected to said structure for displacing said structure lengthwise of the well.

19. The method of claim 18 including providing valve means at said zone to controllably pass said drilling fluid flowing downstream.

20. In the method of producing pulses in a well fluid in a well pipe string, the steps that include a) producing said pulses at a sub-surface location in the string, for pulse transmission upwardly in the fluid, while flowing drilling fluid downstream in the string past said location, through a zone located sidewardly of said location, b) and varying the flow cross sectional area of said sideward zone for controlling the amplitudes of said pulses, c) providing valve means at said zone to controllably pass said drilling fluid flowing downstream, d) and including yieldably biasing valve means to increasingly pass the well fluid flowing downstream in response to increasing downward pressure exerted by the well fluid.

21. In the method of producing pulses in a well fluid in a well pipe string, the steps that include a) producing said pulses at a sub-surface location in the string, for pulse transmission upwardly in the fluid, while flowing drilling fluid downstream in the string past said location, through a zone located sidewardly of said location, b) and varying the flow cross sectional area of said sideward zone for controlling the amplitudes of said pulses, c) providing valve means at said zone to controllably pass said drilling fluid flowing downstream, d) and including yieldably biasing valve means to decreasingly pass the well fluid flowing downstream in response to decreasing downward pressure exerted by the well fluid.

22. The method of claim 19 including providing structure including first means to produce said pulses, providing body means supporting said other valve means, and supporting said structure in a side-by-side relation to said body means.

23. The method of claims 20 and 21 including providing said valve means to include a selected plurality of valves spaced about said location, to correspond in operation to a desired pulse amplitude or amplitudes transmitted in the string.

24. The combination of claim 1 wherein said structure including first means to produce pulses comprises:

i) a tubular body defining a passage to pass well fluid downwardly past said zone, ii) and valving for controllably interrupting the passing of well fluid downwardly past said zone.

25. The combination of claim 24 wherein said valving includes a valve seat, a valve member movable toward and away from the seat, and a piston movable in a bore in said body, and in response to controllable application of well fluid pressure to the piston to control reciprocation of the member in said bore.

26. The combination of claim 25 including a tube extending endwise in said body and having well fluid inlet porting above said seat and well fluid exit porting below said seat to alternatively pass well fluid pressure to the piston, and to the exterior of said body.

27. The combination of claim 26 including a first annular seal sealing off between the piston and said bore, and a second annular seal sealing off between the piston and said tube, the tube extending downwardly within the piston.

28. The combination of claim 26 including a flow diverter carried by said body at a location above the upper end of said tube to divert well fluid to flow toward said zone, and also toward said passage.

29. The combination of claim 28 including a filter carried by said body to filter fluid flowing toward said passage.

30. The method of providing a modulated signaling pulse in well fluid in a drill string, that includes a) providing first and second substantially parallel hydraulic flow paths, in the string, b) controllably interrupting flow in said first path to produce pressure pulses in the well fluid, c) providing for variation in the flow in said second path and to said second path, so as to modulate the pulses, d) providing structure in the string that defines said first path, e) and providing a means connected to said structure for displacing said structure lengthwise of the well.

31. The method of claim 30 wherein said variation of flow in the second path is affected by the pulses.

* * * * *